United States Patent [19]

Kondo et al.

[11] 4,351,996

[45] Sep. 28, 1982

[54] INDUCTION HEATING APPARATUS WITH THERMISTOR AND MAGNETIC SENSOR

[75] Inventors: Shigeki Kondo, Tachikawa; Tomofumi Iketani, Fuchu; Yoshio Yamazaki, Yoshikawa; Keiichiro Doi, Izumi; Seiji Tanaka, Yamatokoriyama, all of Japan

[73] Assignees: Riccar Co., Ltd.; Sharp Kabushiki Kaisha, both of Osaka, Japan

[21] Appl. No.: 229,298

[22] Filed: Jan. 28, 1981

[30] Foreign Application Priority Data

Jan. 30, 1980 [JP] Japan ..... 55-10735
Dec. 15, 1980 [JP] Japan ..... 55-180670[U]

[51] Int. Cl.[3] ..... H05B 6/12

[52] U.S. Cl. ..... 219/10.49 R; 219/10.75; 219/450; 219/518

[58] Field of Search ..... 219/10.49 R, 10.75, 219/10.77, 10.67, 450, 518, 508, 516; 335/208, 146, 302

[56] References Cited

U.S. PATENT DOCUMENTS 3,786,220 1/1974 Harnden, Jr. ..... 219/10.49 R
3,993,885 11/1976 Kominami et al. ..... 219/10.49 R

FOREIGN PATENT DOCUMENTS 1371030 7/1964 France ..... 335/146

*Primary Examiner*—B. A. Reynolds
*Assistant Examiner*—Philip H. Leung
*Attorney, Agent, or Firm*—Birch, Stewart, Kolasch and Birch

[57] ABSTRACT

An improved induction heating apparatus as applied, for example, to a cooking oven in which there is employed a magnet having a bore formed in it, with a thermistor being installed on the top plate of the apparatus in a position corresponding to the bore so as to eliminate possible breakage of the thermistor, while the curie temperature of the magnet member is set at a predetermined level for further improvement in safety.

7 Claims, 6 Drawing Figures

INDUCTION HEATING APPARATUS WITH THERMISTOR AND MAGNETIC SENSOR

The present invention generally relates to an induction heating apparatus and more particularly, to an induction heating apparatus as applied, for example, to a cooking oven which is arranged to detect by a magnet, whether a container for heating is of magnetizable material or not, and also to control the temperature of the container and consequently that of an object to be heated to an optimum level with the employment of a thermistor.

Commonly, in an induction heating apparatus, for example, in an induction heating cooking oven, if a container made of non-magnetizable material is used for the heating, various troubles such as abnormal oscillation of an inverter employed, impression of an extremely large current to the heating coil, commutation failure of control elements, etc. tend to take place through rapid variations of coil impedance, and therefore, there is provided a magnet member so that the cooking oven can be started only when the container of magnetizable material is placed on a top plate of the oven, while a thermistor is also provided for detecting the danger that the abnormal high temperature due to the heating gives rise to deterioration of the coil insulation, i.e. the state as in the so-called heating without objects, and also for controlling energization of the coil so as to maintain the object to be heated at an optimum heating temperature.

Figure 1:
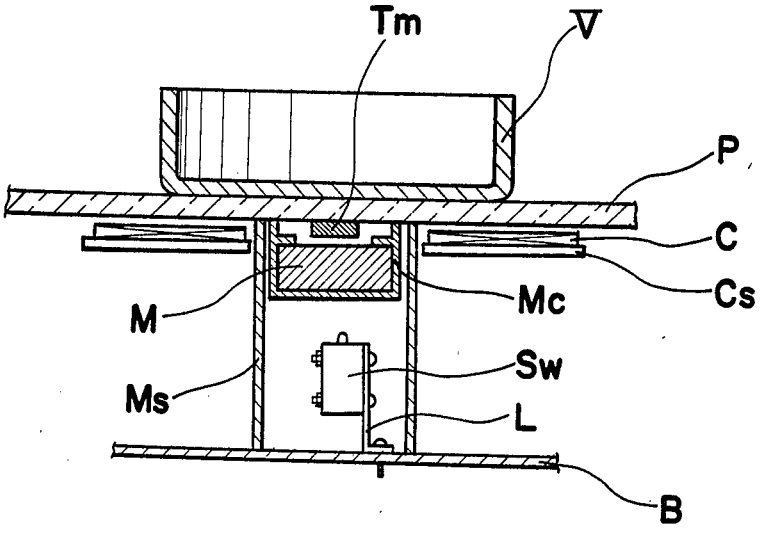
Fig. 1 PRIOR ART

In FIG. 1 showing the construction of a conventional induction heating cooking oven, there is affixed a thermistor Tm at the central portion on the undersurface of a top plate P of the cooking oven for more accurately detecting the temperature of a container V, while a magnet member M is movably accommodated for movement only in the vertical direction, within a magnet support tube Ms, which is surrounded by an induction heating coil C supported by a coil support Cs and in which a microswitch SW secured to a base plate B of the oven through a fixing plate L is provided in a position below the magnet member M so as to be switched over following ascending and decending of the magnet member M. The magnet member M is further accommodated in a cover member Mc to be spaced from the thermistor Tm by a predetermined extent upon contact of the upper edge of the case member Mc with the undersurface of the top plate P for preventing the magnet member M from directly contacting the thermistor Tm when said magnet member M is raised through attraction thereof to the container V.

In the above conventional arrangement, however, there are such disadvantages that the workability during assembly of the oven is extremely inefficient, since the thermistor Tm must be affixed to the undersurface of the top plate P, while wiring for the thermistor Tm has to be carried out by applying current collecting paste or the like onto the top plate P for moving the magnet member 4, and that there is a possibility that the cover member Mc is struck against the undersurface of the top plate P upon attraction of the magnet member M to the container V, and broken by the impact at this time, thus resulting in the breakage of the thermistor Tm.

Accordingly, an essential object of the present invention is to provide an improved induction heating apparatus as applied, for example, to a cooking oven in which there is employed a magnet member having a bore formed therein, with a thermistor being provided on the top plate of the apparatus in a position corresponding to said bore so as to eliminate the disadvantages in the conventional arrangements, while the curie temperature of said magnet member is set at a predetermined level for further improvement in safety.

Another important object of the present invention is to provide an improved induction heating apparatus of the above described type in which there is provided a magnet receptacle for setting or restricting the rising amount of the magnet member through attraction thereof toward the container, while the thermistor is disposed in a recess of said magnet receptactle so as to be pressed against the top plate for protecting the thermistor from possible breakage and also for efficient assembly of the apparatus during manufacture.

A still further object of the present invention is to provide an improved induction heating apparatus of the above described type which is simple in construction and stable in functioning, and can be manufactured on a large scale at low cost.

In accomplishing these and other objects, according to one preferred embodiment of the present invention, there is provided an induction heating apparatus having an induction heating coil disposed below a top plate for supporting a container of magnetizable material, and comprising a thermistor element provided on the undersurface of the top plate for controlling energization of the induction heating coil, a magnet member movably provided below the top plate so as to be raised through attraction thereof with respect to the container, and a switching member provided below the magnet member for selective energization and de-energization of the induction heating coil in association with the movement of the magnet member. The magnet member is formed therein with a bore in a predetermined position corresponding to the thermistor element so as to accommodate the thermistor element into the bore upon rising of the magnet member for preventing collision therebetween.

By the arrangement according to the present invention as described above, an improved induction heating apparatus free from the possibility of breakage of the thermistor element has been advantageously presented through simple construction, with substantial elimination of disadvantages inherent in the conventional induction heating apparatuses of this kind.

Figure 2:
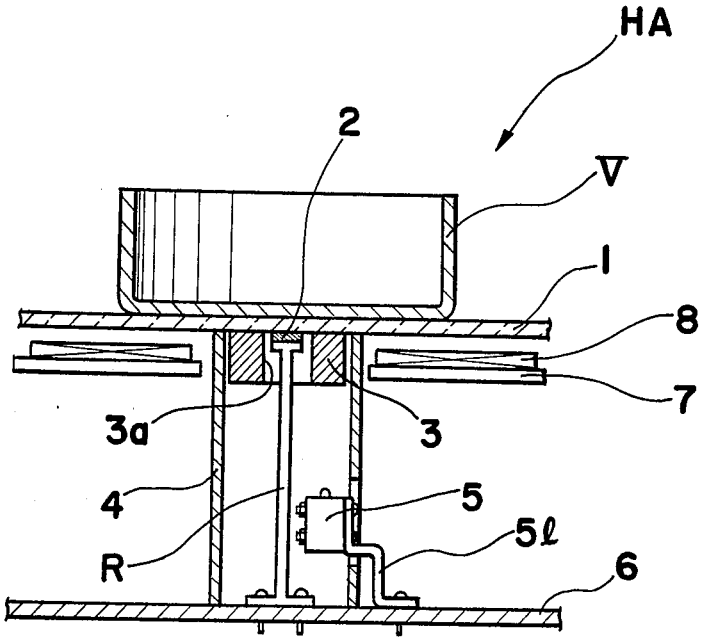
Figure 3:
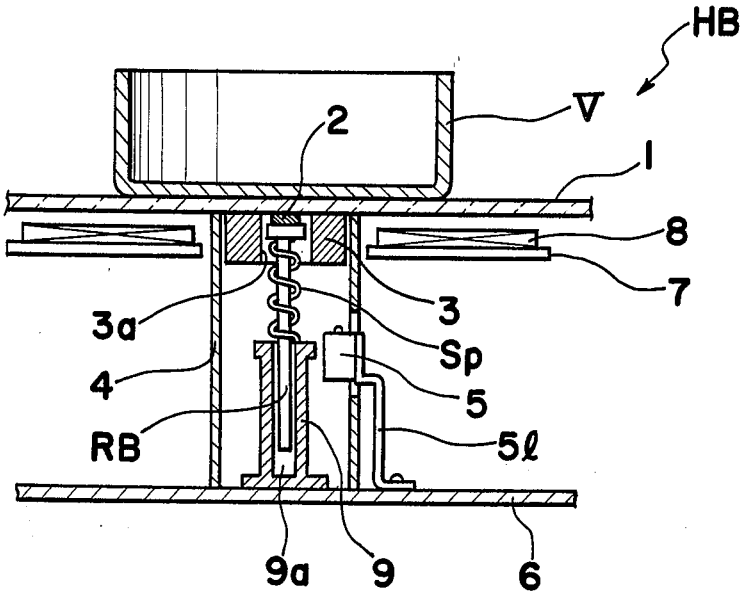
Figure 4:
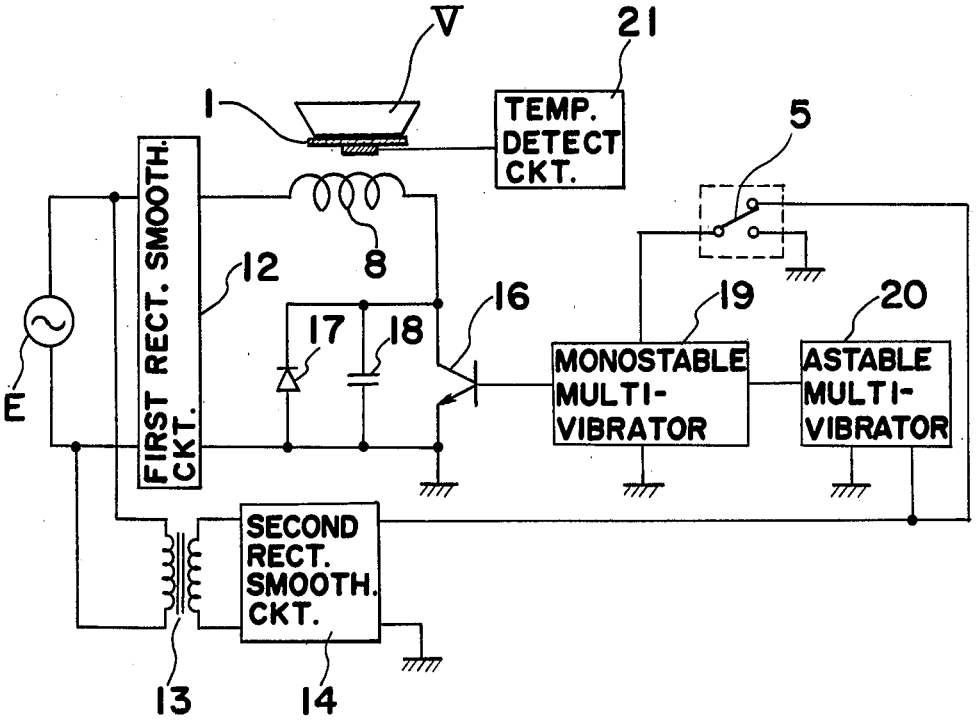
Figure 5:
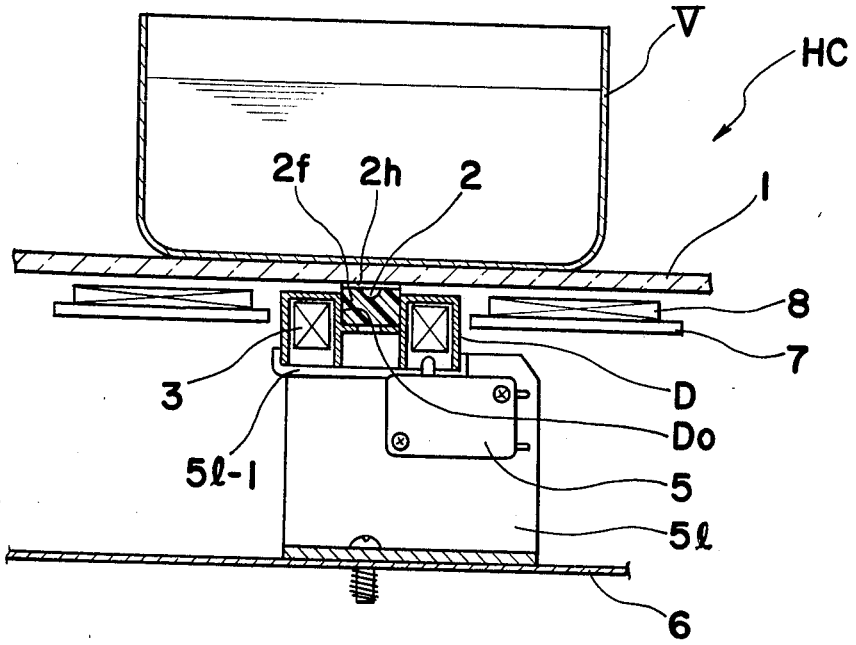
Figure 6:
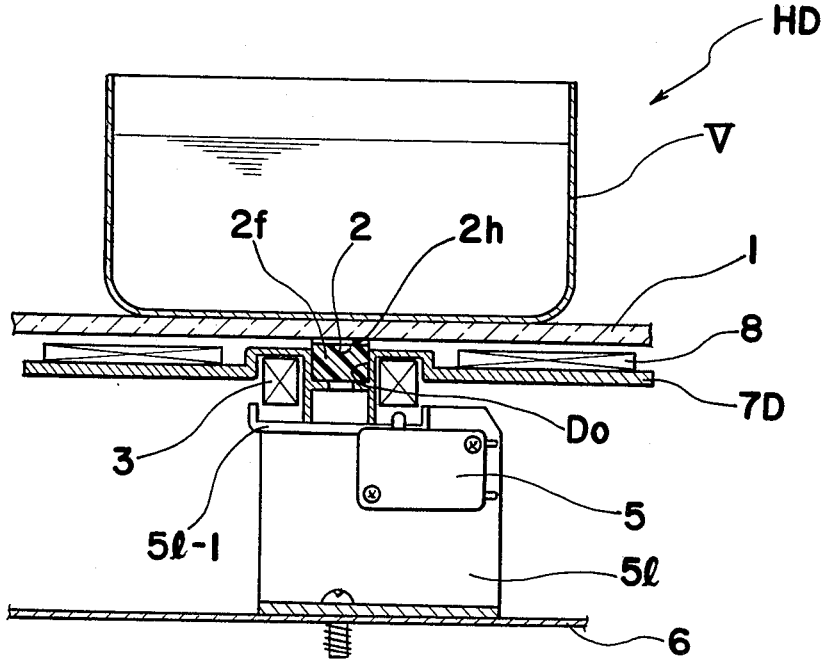

These and other objects and features of the present invention will become apparent from the following description taken in conjunction with the preferred embodiment thereof with reference to the accompanying drawings, in which;

FIG. 1 is a fragmentary side sectional view showing a main portion of a conventional induction heating apparatus (already referred to), FIG. 2 is a fragmentary side sectional view showing a main portion of an improved induction heating apparatus according to one preferred embodiment of the present invention, FIG. 3 is a view similar to FIG. 2, which particularly shows a modification thereof, FIG. 4 is an electrical block diagram showing the circuit construction of the heating apparatuses of FIGS. 2 and 3, FIG. 5 is a view similar to FIG. 2, which particularly shows another modification thereof, and FIG. 6 is a view similar to FIG. 5, which particularly shows a further modification thereof.

Before the description of the present invention proceeds, it is to be noted that like parts are designated by like reference numerals throughout several views of the accompanying drawings.

Referring now to the drawings, there is shown in FIG. 2 a main portion of an improved induction heating apparatus HA according to one preferred embodiment of the present invention. The heating apparatus HA generally includes a top plate 1 provided in the predetermined position in the apparatus housing for placing thereon a container or vessel V, a heat sensing element or thermistor 2 attached to the central portion on the undersurface of the top plate 1, a magnet support tube 4 provided between the central portion of the undersurface of the top plate 1 and a bottom plate 6 of the apparatus housing, a magnet member 3, for example, of cylindrical shape having a bore 3*a* formed therein and movably supported in the support tube 4 for movement only in the vertical direction, a microswitch 5 provided in the support tube 4 in a position below the magnet member 3 at a predetermined height from the bottom plate 6 and secured to said bottom plate 6 through a support plate 5*l* so as to be selectively turned ON or OFF following the vertical movement of the magnet member 3, and an induction coil or heating coil 8 supported by a coil support 7 and surrounding the support tube 4 in a position adjacent to the top plate 1. The thermistor 2 which is supported and pressed against the undersurface of the top plate 1 by one end of a support rod R extending through the bore 3*a* and secured at its other end to the base plate 6 is arranged to be accommodated into the bore 3*a* of the cylindrical magnet member 3 when said magnet member 3 is raised towards the top plate 1, while the curie temperature of the magnet member 3 is set to be lower than the temperature at the undersurface of the top plate 1 when the temperature of the induction heating coil 8 has reached its allowable limit.

In FIG. 3, there is shown a modification of the induction heating apparatus HA of FIG. 2. In the modified induction heating apparatus HB of FIG. 3, the support rod R for the thermistor 2 in the arrangement of FIG. 2 is replaced by a support rod RB which supports the thermistor 2 at its one end, and is movably received at its other end in a cylindrical bore 9*a* of a support tube 9 suitably secured to the base plate 6, while a spring member Sp is disposed around the support rod RB in a position between the upper end of the rod RB and the upper edge of the support tube 9 for normally urging the rod RB upwardly in FIG. 3 so as to achieve closer contact of the thermistor 2 with respect to the undersurface of the top plate 1.

Since other constructions and functions of the modified heating apparatus HB of FIG. 3 are generally similar to those of the arrangement of FIG. 2, detailed description thereof is omitted here for brevity.

Referring also to FIG. 4 showing an electrical block diagram for the induction heating apparatus according to the present invention, a first rectification and smoothing circuit 12 and the primary winding of a transformer 13 are connected across the terminals of an AC power source E, while the induction heating coil 8 and the emitter and collector of an output transistor 16 are connected in series between the positive and negative terminals of the first rectification and smoothing circuit 12. A protecting diode 17 is connected in the reverse direction between the collector and emitter of the output transistor 16, with a capacitor 18 being connected in parallel to the protecting diode 17. To the secondary winding of the transformer 13, a second rectification and smoothing circuit 14 is coupled, while the positive terminal of the second rectification and smoothing circuit 14 is connected to the positive terminal of a monostable multi-vibrator 19 through the microswitch 5, and the negative terminal of said circuit 14 is coupled to the ground terminals of the monostable multi-vibrator 19 and an astable multivibrator 20 coupled to said monostable multi-vibrator 19, with the output terminal of the monostable multivibrator 19 being connected to the base of said output transistor 16. The thermistor 2 is coupled to a temperature detecting circuit 21 so as to control, for example, the base input signal for the output transistor 16 or output signal of said transistor 16 by the output signal of the temperature detecting circuit 21.

By the above arrangement, the heating operation is started upon turning ON of a starting switch (not shown), with the container V placed on the top plate 1.

If the container V is of magnetizable material, the magnet member 3 is raised through the attraction thereof towards the container V, and thus, the microswitch 5 which is normally open through depression by the magnet member 3 is closed to apply positive voltage to the positive terminal of the monostable multi-vibrator 19.

Accordingly, the monostable multi-vibrator 19 produces pulses of a width of predetermined time, rising at the timing of the pulse periodically developed from the astable multi-vibrator 20, and by rendering the output transistor 16 conductive with the output pulse of the monostable multi-vibrator 19, the induction heating coil 8 is energized for the inductiion heating operation.

As the induction heating is continued, the temperature of the container V is raised, with consequent decrease of the resistance value of the thermistor 2, and when the temperature of the container V has reached the predetermined level, and the resistance of the thermistor 2 has been decreased down to the predetermined value, the temperature detecting circuit 21 functions to cut off the input signal or output signal, etc. of the output transistor 16.

Therefore, not only the object to be cooked accommodated in the container V is maintained at the optimum heating temperature, but also the abnormal heating of the container V can be positively prevented. Moreover, in the case where there are some troubles in the thermistor 2 or in the temperature detection circuit 21, the above function is not to be effected, but upon further rising of the temperature of the container V, when the temperature of the magnet member 3 reaches the curie temperature, the magnet member 3 loses its magnetism and falls downwards by its weight so as to open the microswitch 5, and the monostable multivibrator 19 stops producing the pulses, and thus, energization of the induction heating coil 8 is cut off, with the heating operation suspended. Therefore, further improvement is achieved for the safety operation of the heating apparatus. On the other hand, if the container V is of non-magnetizable material, the magnet member 3 does not ascend at all, with the microswitch 5 being kept opened, and thus, no heating operation is effected.

As is seen from the foregoing description, according to the induction heating apparatus of the present invention, since the bore 3*a* for accommodating therein the thermistor 2 is provided in the magnet member 3, the magnet member never strikes against the thermistor 2 directly during its ascending, with the possibility of breakage of the thermistor being completely eliminated.

Furthermore, since the curie temperature of the magnet member is set to be lower than the temperature at the undersurface of the top plate 1 at the time upon reaching the allowable limit temperature, the abnormal temperature rise due to heating, especially heating without objects, may be positively prevented even if the thermistor should be in trouble.

Referring to FIG. 5, there is shown a further modification of the arrangement of FIG. 2. In this modified inducting heating apparatus HC of FIG. 5, the magnet support tube 4 and thermistor support rod R described as employed in the arrangement of FIG. 2 are dispensed with and the magnet member 3 is movably accommodated in a magnet receptacle or casing D which is supported by a plate 5*l*-1 laterally extending from the upper edge of the support plate 5*l* for the microswitch 5 and arranged to restrict the lateral movement and amount of rising of the magnet member 3 through the magnetic attraction. The magnet receptacle D having the configuration conforming with the external shape of the magnet member 3 has a recess Do at its central portion corresponding to the bore 3*a* of the magnet member 3. In the recess Do, there is disposed a resilient thermistor support material 2*f*, for example, of expanded silicone rubber or the like on which the thermistor 2 is mounted, while on the thermistor 2, a heat collecting plate 2*h* is disposed for effectively conducting the heat of the top plate 1 to the thermistor 2. Moreover, since the height from the upper surface of the magnet receptacle D to the upper surface of the heat collecting plate 2*h* is arranged to be higher than the height from the upper surface of the receptacle D to the undersurface of the top plate 1, the resilient thermistor support material 2*f* is normally compressed between the undersurface of the top plate 1 and the bottom wall of the recess Do, and thus, the heat collecting plate 2*h* and the thermistor 2 are pressed against the undersurface of the top plate 1. The microswitch 5 is disposed below the magnet member 3 through the support plate 5*l* for restricting the decending amount of the magnet member 3 and also for being selectively opened or closed in association with the movements of the magnet member 3 in the similar manner as in the arrangement of FIG. 2.

In the above arrangement of FIG. 5, when the container V of magnetizable material is placed at a predetermined position on the top plate 1, the magnet member 3 is attracted by the container V and attached to the inner face of the upper portion of the magnet receptacle D, while the contacts of the microswitch 5 are changed over in association therewith to start the heating, with the thermistor controlling the energization of the heating coil 8 for maintaining the container V to be heated at the optimum temperature.

On the contrary, if a container V of non-magnetizable material should be placed on the top plate 1, the magnet member 3 is not attracted thereby at all, with the microswitch 5 kept open or turned OFF, and therefore, the heating coil 8 is never energized.

In the above arrangement, since the magnet receptacle D remains stationary, with only the magnet member 3 vertically moving within the receptacle D, neither the magnet member 3 nor the magnet receptacle D is brought into contact with the top plate 1 and the heat sensing element or thermistor 2, and thus, not only the impact noises are reduced to a large extent, but the top plate, magnet receptacle, thermistor, etc. are completely free from the danger of breakage.

Furthermore, for the installation of the heat sensing element also, troublesome procedures such as bonding, application of electrically conductive paste, etc. are advantageously dispensed with, through the elastic supporting of the thermistor merely by the resilient thermistor support material, and thus, assembly of the heating apparatus is markedly facilitated, with consequent improvements on the working efficiency.

Referring to FIG. 6, there is shown another modification of the arrangement of FIG. 5. In the modified heating apparatus HD of FIG. 6, the magnet receptacle D in the arrangement of FIG. 5 is arranged to be integrally formed with the coil support 7D, with the thermistor 2 disposed in the central recess Do in the similar manner as in the arrangement of FIG. 5 for simplification of the construction and facilitation of processing during manufacture.

Since other constructions and functions of the heating apparatus HD of FIG. 6 are similar to those in the arrangement of FIG. 5, detailed description thereof is abbreviated here for brevity.

It should be noted here that, in the foregoing embodiments, although the present invention has been mainly described with reference to the induction heating apparatus as applied to the cooking ovens, the concept of the present invention is not limited in its application to the cooking ovens alone, but may readily be applied to induction heating apparatuses for industrial purposes in general as well.

As is clear from the foregoing description, in the induction heating apparatuses HC and HD according to the present invention, since the magnet member and magnet casing or the like are arranged not to be brought into contact with the top plate, possible breakage of the top plate, magnet receptacle, heat sensing element, etc. is positively prevented. Moreover, owing to the arrangement in which the heat sensing element is adapted to be pressed against the top plate through the elastic supporting of said heat sensing element by the magnet receptacle, it becomes unnecessary to bond the heat sensing element to the top plate or to apply electrically conductive paste for the purpose, with consequent improvements on workability during manufacture.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as included therein.

What is claimed is:

1. An induction heating apparatus having an induction heating coil provided below a top plate means for supporting a container of magnetizable material thereon, said induction heating apparatus comprising:

thermistor element means provided on the undersurface of said top plate means for controlling energization of said induction heating coil;

magnet member means movably provided below said top plate means so as to be raised through attraction thereof to a said container of magnetizable material on said top plate means; and switching member means provided below said magnet member means for selective energization and de-energization of said induction heating coil in response to the movement of said magnet member means;

said magnet member means being formed to define bore means therethrough in a predetermined position corresponding to said thermistor element means so as to accommodate said thermistor element means into said bore means upon raising of said magnet member means for preventing collision therebetween and for providing access to said thermistor element means from beneath said magnet member means; and said apparatus further comprising support means for thermistor element means extending through said bore means.

2. An induction heating apparatus as claimed in claim 1, which further includes:

a base plate beneath said magnet member means; and wherein said support means comprises support rod means extending from said base plate through said bore means in said magnet member means for supporting and pressing said thermistor element means against the undersurface of said top plate for close contact therewith.

3. An induction heating apparatus as claimed in claim 1, which further includes:

a base plate beneath said magnet member means; and wherein said support means comprises support rod means extending from said base plate through said bore means in said magnet member means for supporting and pressing said thermistor element means against the undersurface of said top plate for close contact therewith;

said support rod means further comprising support tube means secured to said base plate, movable rod means for supporting and energizing said thermistor element means on one end thereof telescopically mounted within said support tube means, and spring means intermediate said support tube means and said movable rod means for constraining the latter to press said thermistor element means against said undersurface of said top plate.

4. An induction heating apparatus as claimed in claim 1, which further includes:

a base plate beneath said magnet member means; and wherein said support means comprises support tube means for movably accommodating said magnet member means between said base plate and said top plate;

said switching member means being disposed below said magnet member means in said support tube means at a predetermined height above said base plate.

5. An induction heating apparatus as claimed in claim 1, wherein said support means comprises magnet receptacle means provided below and adjacent to said top plate for movably accommodating said magnet member means and having a recess defined therein of a shape conforming to said bore means; and wherein said thermistor element means is mounted in said recess in said magnet receptacle means and comprises:

a resilient support member in said recess;

a thermistor element on said resilient support member; and a heat collecting plate covering said thermistor element adjacent the undersurface of said top plate;

said magnet receptacle means being so positioned as to press said heat collecting plate of said thermistor element means in close contact with the said undersurface of said top plate.

6. An induction heating apparatus as claimed in claim 5, wherein said magnet receptacle means further includes integral coil support means for said induction heating coil.

7. An induction heating apparatus comprising:

top plate means for supporting a container of magnetizable material thereon;

induction heating coil means beneath said top plate means for heating a said container and its contents;

hollow magnet member means beneath said plate means responsive to the presence of a said container thereon to assume a raised position through attraction thereof with respect to said container;

switching member means responsive to movement of said magnet member means for selectively energizing and de-energizing said induction heating coil means;

magnet receptacle means movably accommodating said hollow magnet member means beneath said top plate means and restricting the upward movement thereof; and thermistor element means mounted on said magnet receptacle means in registry with the hollow portion of said magnet member means in the said raised position thereof and pressed against said top plate means for controlling energization of said induction heating coil and maintaining the temperature of said container and its contents being heated thereby.

* * * * *